United States Patent [19]

Nassetti

[11] Patent Number: 4,923,397

[45] Date of Patent: May 8, 1990

[54] FLAT SEPARATION FLOOR BETWEEN TWO SUPERPOSED CHAMBERS IN KILNS, IN PARTICULAR ROLLER-HEARTH KILNS FOR CERAMIC TILES

[75] Inventor: Roberto Nassetti, Milan, Italy

[73] Assignee: T.T.C. Termo Tecnica Ceramica S.P.A., Matena, Italy

[21] Appl. No.: 336,126

[22] Filed: Apr. 11, 1989

[30] Foreign Application Priority Data

Apr. 29, 1988 [IT] Italy ..... 46843 A/88

[51] Int. Cl.[5] ..... F27D 1/00

[52] U.S. Cl. ..... 432/251; 110/336; 432/247

[58] Field of Search ..... 110/336, 331; 432/251, 432/238, 247

[56] References Cited

U.S. PATENT DOCUMENTS

| | | | |
|---|---|---|---|
| 2,101,786 | 12/1937 | Wise | 432/251 X |
| 2,126,325 | 8/1938 | Hawke | 432/251 X |
| 2,218,806 | 10/1940 | Betterton et al. | 432/251 X |
| 2,598,474 | 5/1952 | Weaver | 432/256 X |
| 4,512,738 | 4/1985 | Hartmann | 432/247 |

*Primary Examiner*—Edward G. Favors

[57] ABSTRACT

A floor which comprises a plurality of structural elements (10) of elongated parallelepiped shape with their longitudinal axis disposed horizontally. The structural elements are disposed adjacent to each other to form a flat horizontal structure supported by two opposing vertical walls (23) and 24) of the kiln. Each structural element (10) comprises two internal beams (11) positioned to the axis of the element and a plurality of blocks (12) of thermally insulating material, each being provided with two through holes (13) by which they are mounted along the internal beams (11). The blocks (12) are slidable along the internal beams (11); means also being provided for acting on the ends of the row of said blocks (12) to compress the row in an axial direction, thereby pressing the blocks together. The internal beams (11) are stressed only partially by the weight of the blocks (12), which can therefore have a greater specific gravity or thickness to increase the insulating effect of the floor.

5 Claims, 2 Drawing Sheets

FLAT SEPARATION FLOOR BETWEEN TWO SUPERPOSED CHAMBERS IN KILNS, IN PARTICULAR ROLLER-HEARTH KILNS FOR CERAMIC TILES

BACKGROUND OF THE INVENTION

This invention relates to the manufacture of kilns of the superposed chamber type, in particular roller-hearth kilns for ceramic tiles.

In said kilns it is important to provide effective thermal insulation between the superposed chambers to render them thermally independent.

For this purpose separation floors are currently used consisting of bending-stressed beams supporting an upper layer and a lower layer of insulating refractory material which both separate the two chambers thermally and protect the beams from heat.

However the beams remain inevitably subjected to the action of heat (normally reaching temperatures exceeding 1000° C.), and because of this plus the fact that they support the entire weight of the floor under bending stress, the floor has to be relatively light in order not to compromise the stability of the structure.

For this reason it is not possible in practice to construct a floor which satisfactorily separates the superposed chambers from each other because light and unfortunately poor insulating materials and/or too small thicknesses have to be used for the insulating layer.

SUMMARY OF THE INVENTION

An object of the present invention is to provide a floor in which, other factors being equal, the load-bearing beams are stressed to a lesser extent thereby allowing for example the use of an insulating refractory layer of relatively greater weight (for example using better insulating material of greater specific gravity) and/or a layer of greater thickness.

By this means a floor can be provided which is able to thermally separate the superposed kiln chambers more efficiently.

This and further objects are attained by the floor of the present invention as characterised in the claims.

According to the present invention, by forming a more highly insulating layer, a more effective insulation of the internal beams is also obtained so that they are less subject to the repeated temperature variations which occur in the kiln, for example when one or both the of chambers are extinguished or ignited.

A further advantage of the present invention is the ability to extract, relatively easily from the kiln, one or more of the component structural elements of the floor for example in the case of wear or damage to the component blocks of the structural element.

A further advantage of the present invention is the fact that the component blocks of the floor expand on heating, thereby undergoing mutual compression which improves the seal between the blocks.

The present invention is described in detail hereinafter with reference to the accompanying figures, which show a preferred but not exclusive embodiment thereof, wherein.

Figure 1:
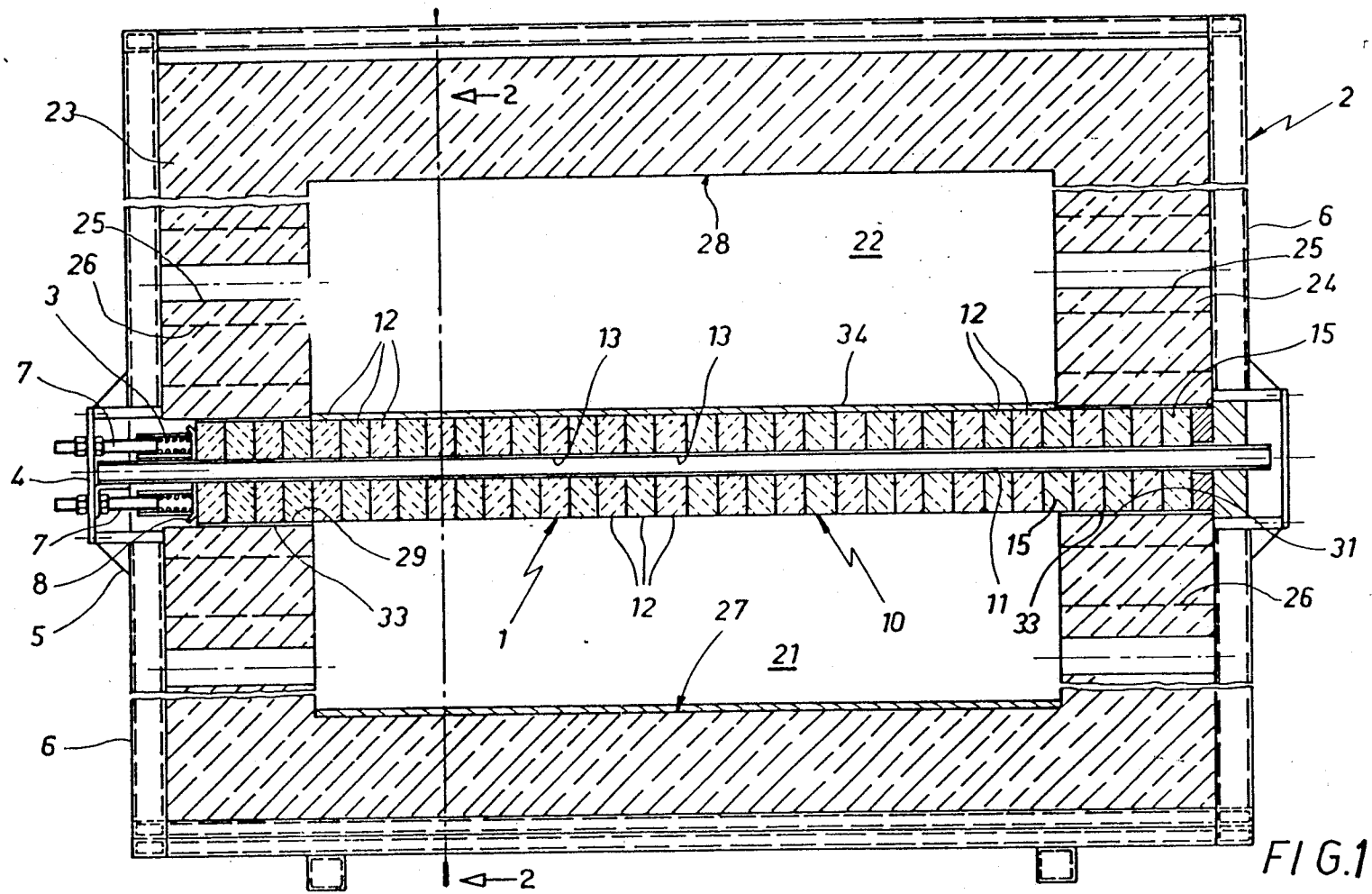
FIG. 1 is a section on a vertical transverse plane through the kiln to which the floor of the invention is applied.
Figure 2:
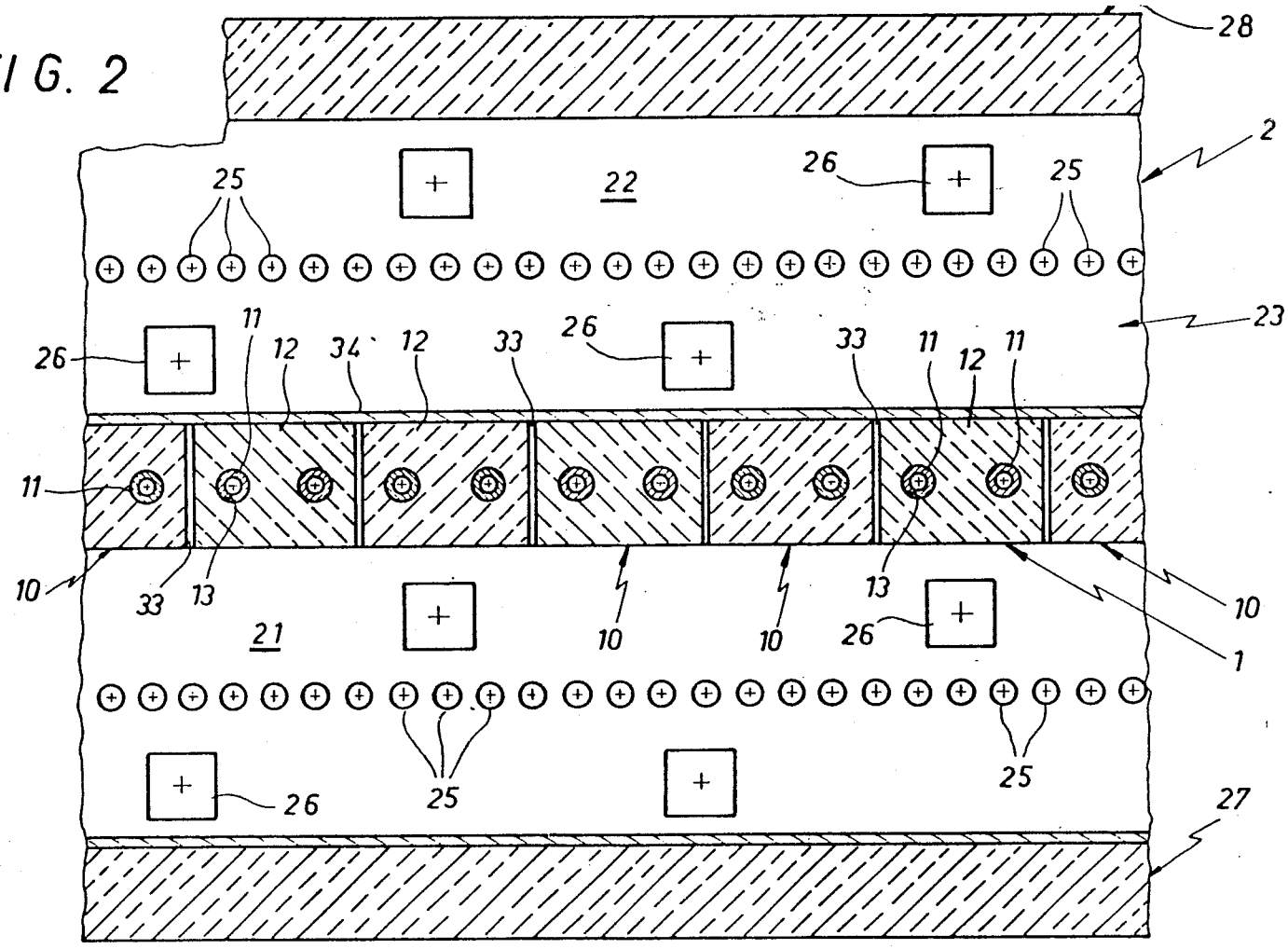
FIG. 2 is a section taken along line II—II of FIG. 1.

In said figures reference numeral 1 indicates overall the floor according to the present invention, while element 2 indicates overall the kiln to which the floor 1 is applied.

The kiln 2 is illustrated only very diagrammatically as its details are not relevant.

Substantially, the kiln 2 comprises a lower chamber 21 and a higher chamber 22 which are insulated from each other by the floor 1 and are bounded laterally by two opposing vertical walls 23 and 24, respectively.

In the walls 23 and 24 there are provided holes 25 through which rollers (not shown) pass for conveying the objects within the chambers 21 and 22, and holes 26 through which the kiln burners are inserted.

The kiln base 27 is positioned below the chamber 21 and the roof 28 is positioned above the chamber 22.

The floor 1 comprises a plurality of structural elements 10 of elongated parallelepiped shape with their longitudinal axis being horizontal. The elements 10 are disposed parallel and adjacent to each other to form a flat horizontal sturcture supported by two opposing vertical walls.

Each element 10 comprises at least one internal beam 11, and specifically in this case two beams parallel to the axis of element 10, and a plurality of identical thermal insulation blocks 12, also of a parallelepiped shape and each provided with holes 13, one for each beam, by which they are mounted along the internal beams 11. The blocks 12 are typically of insulating refractory material and the holes 13 are of circular cross-section. The beam 11 is of corresponding tubular shape with its outer diameter slightly less than the diameter of the holes 13. The blocks 12 are axially slidable along the beams 11, and means are also, acting on the ends of the row of blocks 12 to compress the row in an axial direction thereby pressing the blocks 12 together.

In the illustrated embodiment, said means comprise strong elastic springs precompressed between one end of the row of blocks 12 and an element 4 rigid with a vertical wall 23 or 24 of the kiln. The other end of the row of blocks 12 is pressed against the opposite vertical wall 24 or 23, respectively.

The element 4 consists in particular of a plate secured by brackets 5 to a metal structure 6 provided on both the vertical walls 23 and 24 and fixed to their outside.

Between the plate 4 and the corresponding end of the row of blocks 12 there is disposed a pair of telescopic struts 7 in which the springs 3 are positioned to press on a plate 8 resting against the first block 12 of the row.

One end of the struts 7 is threaded and is fixed to the plate 4 by large nuts screwed thereto. By screwing or unscrewing these nuts, the precompression of the springs 3 can be adjusted in the sense hthat they press against the row of blocks 12 to a greater or lesser extent.

The walls 23 and 24 are provided with through holes 29 through which the structural elements 10 pass as an exact fit (the crosssection of the holes 29 is therefore similar to but slightly larger than the cross-section of the blocks 12) and in which the blocks 12 lying in proximity to the spring 3 rest.

In opposite wall 24 or 23 respectively, on the axis of each hole 29, there is provided an identical hole 31 in which a few blocks 15 identical to the blocks 12 are placed and are rigidly secured to the wall to form an integral part thereof. Within each element 10 the internal beams 11 traverse all the blocks 12 and 15 to protect slightly from both sides of the kiln where they emerge from the row of blocks 12 and 15.

The end portions of the beams 11 are supported within the holes of the blocks 15 and within the holes of those blocks 12 which rest in the hole 29.

The blocks 12 disposed within the kiln are supported by the beam 11, which is thus subjected to bending stress by the weight of the blocks.

However, the action of the precompressed springs 1 combined with the reaction of the fixed blocks 15 compresses the row of blocks 12 in an axial, direction, thus pressing them against each other. This compression action counteracts the flexural deformation of the row of blocks 12 and tends to keep the axis of the row straight so that this becomes at least partially self-supporting to at least partly discharge the load acting on the internal beams 11 caused by the weight of the blocks 12.

This action, which is favourable for the beam, therefrom increases with increasing kiln temperature. As the blocks 12 expand as their temperature increases, the total length of the row, and thus the compression of the springs 3 in increased.

As the beams are stressed to a relatively lesser extent than when in the situation where the weight of the blocks is completely discharged onto the beams, it is possible to use relatively heavier rows of blocks 12, for example, by increasing the thickness of the blocks 12 in the vertical direction or by using materials of higher specific gravity, so as to increase the insulating action of the floor 11 and also increase the mechanical hardness of the floor. This is particualrly useful because of the impact on the floor by objects which fall from the conveying rollers.

The various rows of blocks 12 are positioned side by side and adjacent to each other to form a single horizontal flat floor.

The holes 29 are advantageously provided alternately, in the wall 23 and in the wall 24 and, vice versa. The holes 31 are provided alternately in the wall 24 and in the wall 23, so that in each wall 23 and 24 there are provided holes 29 through which the blocks 12 are inserted and extracted, alternating with holes 31 which are closed by the blocks 15.

Between these mutually contacting surfaces which undergo relative movement due to expansion there are obviously provided suitable layers of gasket material, for example between one element 10 and the next and between the internal surface of the holes 29 and the blocks 12 resting within these latter holes.

A thin layer 34 can also be provided on the upper surface of the floor 1 to provide mechanical protection for the blocks 12.

In addition to the described advantage of relatively lower stressing of the internal beams 11, the present invention also has the advantage that the structural elements 10 can be relatively easily extracted through the holes 29, for example to change worn or broken blocks 12.

Furthermore, an excellent seal is obtained between the blocks of each row because of the opposition to the high-temperature expansion of the blocks provided by the thrust of the springs 3.

In addition, the beams 11 are effectively insulated within the rows of blocks 12, so being less exposed to the temperature variations which occur when the kiln is extinguished or re-ignited and not subjected to the atmosphere within the kiln, which is chemically corrosive.

In a different embodiment of the present invention, not shown in the figures, the reaction to the compression produced by the springs 3 is provided by the internal beams 11, which are thus subjected to tension, by making the plate 4 rigid with one end of the beams 11 and providing a further plate rigid with the other end of the beams 11 and against which the corresponding end of the roof blocks 12 rests. In this case the blocks 15 are not fixed to the respective vertical wall 23 or 24, and act as the blocks 12.

Numerous modifications of a practical and applicational nature can obviously be made to the present invention, but without departure from scope of the invention as defined by the claims.

I claim:

1. A separation floor disposed between two superimposed chambers of a kiln, in particular, in a roller-hearth kiln for ceramic tiles, which comprises a plurality of structural elements (10) of rectilinear elongated shape and disposed parallel and adjacent to each other to form a flat horizontal structure supported by two opposing vertical walls (23) and (24), each structural element (10) comprising:

at least one internal beam (11) disposed parallel to the axis of said element;

a plurality of thermal insulation blocks (12) each provided with through holes (13), one for each internal beam (11), and mounted along the internal beam (11), said blocks (12) being slidable along the internal beam (11); and means acting on the ends of the row of said blocks to compress the row in an axial direction thereby pressing the blocks (12) together.

2. The floor as claimed in claim 1, wherein said means which compress the row of blocks (12) comprise elastic means (3) precompressed between one end of the row of blocks (12) and an element (4) which is rigidly disposed with respect to a vertical wall of the kiln, the other end of the row of blocks (12) being pressed against the opposite vertical wall of the kiln.

3. The floor as claimed in claim 2, wherein the vertical walls of the kiln are provided with through holes (29) through which the structural elements (10) pass and in which the end blocks (12) of the row rest.

4. The floor as claimed in claim 3, wherein one hole (29) is provided for each structural element (10), said holes (29) being disposed alternately in one and in the other vertical wall of the kiln.

5. The floor as claimed in claim 1, wherein said blocks (12) are of parallelepiped shape and are provided with through holes (13), one for each beam (11), said internal beams (11) being of circular, tubular form with their outer diameter being slightly less than the diameter of the holes (13).

* * * * *